US006523518B2

(12) United States Patent
Kunde et al.

(10) Patent No.: US 6,523,518 B2
(45) Date of Patent: Feb. 25, 2003

(54) CYLINDER HEAD ASSEMBLY COMPRISING A HOLDER FOR THE ATTACHMENTS OF UNITS

(75) Inventors: Detlev Kunde, Noervenich (DE); Guido Bingen, Cologne (DE); Gunnar Gangel, Jr., Cologne (DE); Hans-Joachim Reincke, Overath (DE)

(73) Assignee: Ford Global Technologies, Inc., Dearborn, MI (US)

( * ) Notice: Subject to any disclaimer, the term of this patent is extended or adjusted under 35 U.S.C. 154(b) by 0 days.

(21) Appl. No.: 10/064,200

(22) Filed: Jun. 20, 2002

(65) Prior Publication Data

US 2003/0005903 A1 Jan. 9, 2003

(30) Foreign Application Priority Data

Jul. 4, 2001 (EP) ..... 01116173

(51) Int. Cl.[7] ..... F01L 1/04
(52) U.S. Cl. ..... 123/193.5
(58) Field of Search ..... 123/193.5, 193.3, 123/195 R, 195 A, 195 C

(56) References Cited

U.S. PATENT DOCUMENTS

| | | | | |
|---|---|---|---|---|
| 4,754,729 A | | 7/1988 | Abe et al. | |
| 5,119,776 A | * | 6/1992 | Bakker | 123/193.5 |
| 6,148,787 A | * | 11/2000 | Takano | 123/195 A |
| 6,170,471 B1 | * | 1/2001 | Yonezawa et al. | 123/508 |
| 6,209,505 B1 | * | 4/2001 | Hori et al. | 123/193.5 |
| 6,460,330 B1 | * | 10/2002 | Yoshida et al. | 123/579 |

FOREIGN PATENT DOCUMENTS

| | | |
|---|---|---|
| DE | 4212255 A1 | 10/1993 |
| DE | 4301069 A1 | 7/1994 |
| EP | 0459466 B1 | 5/1991 |

* cited by examiner

*Primary Examiner*—Marguerite McMahon
(74) *Attorney, Agent, or Firm*—Diana D. Brehob

(57) ABSTRACT

The invention relates to a holder for the attachment of units, preferably of fuel-pressure injection pumps to cylinder heads of reciprocating internal combustion engines. In this case, the holder replaces one or more camshaft bearing caps and thus permits a high-pressure fuel injection pump to be installed and operated in a simple manner.

5 Claims, 1 Drawing Sheet

CYLINDER HEAD ASSEMBLY COMPRISING A HOLDER FOR THE ATTACHMENTS OF UNITS

BACKGROUND OF INVENTION

1. Field of the Invention

The invention relates to a cylinder head assembly comprising a holder for the attachment of units, preferably for the attachment of a high-pressure fuel injection pump onto the cylinder head of a reciprocating internal combustion engine, and a camshaft fitted to the cylinder head with at least two camshaft bearing caps.

2. Description of the Prior Art

Single-cylinder high-pressure fuel injection pumps which are attached to cylinder heads of reciprocating internal combustion engines are disclosed, for example, in DE 198 57 555. In this case, a single-cylinder high-pressure fuel injection pump is actuated by at least two additional cams which are situated at the end of a camshaft which runs in the cylinder head and is responsible for controlling the gas exchange valves. These cams also actuate a bucket tappet which in turn drives a high-pressure fuel injection pump which is connected here directly to the cylinder head with a force fit.

This above-described arrangement has a number of disadvantages. Firstly, an enlargement of the cylinder head is required because of the arrangement of the driving cams for the high-pressure fuel injection pump at the end of the existing camshaft. For package reasons this is frequently difficult to realize in particular in the case of reciprocating internal combustion engines which are installed transversely in the motor vehicle.

Secondly, the receiving bore for the bucket tappet for operating the high-pressure fuel injection pump requires additional machining steps for the cylinder head, which is in any case already very complicated to manufacture. If, for example, for a reciprocating internal combustion engine which is already mass-produced without a high-pressure fuel injection pump, a version having a high-pressure fuel injection pump is additionally to be manufactured, the component complexity for the manufacturer is increased.

SUMMARY OF INVENTION

The improved cylinder head assembly according to the present invention is characterized in that the holder for the attachment of units, preferably for the attachment of high-pressure fuel injection pumps, is designed in such a manner that it contains at least one camshaft bearing cap. At the same time, the existing bores which have originally been conceived only for the attachment of a camshaft bearing cap are used here for the attachment of the holder according to the invention. Therefore, in comparison with a version of a cylinder head without a high-pressure fuel injection pump, no additional machining steps on the cylinder head are necessary. However, in order to ensure that the holder is sufficiently stable, a third attachment or support point is also necessary.

In an advantageous refinement of the invention, two or more camshaft bearing caps are replaced by the holder for the attachment of high-pressure fuel injection pumps. This is a version which is particularly simple to realize and does not require any changes in terms of structure or production engineering to the cylinder head of a reciprocating internal combustion engine.

It is prior art to drive high-pressure fuel injection pumps by means of one or more cams situated on a shaft. In this case, the rotational movement of the shaft is transmitted via one or more cams to a tappet and is therefore converted into a desired linear movement. This tappet is usually designed as a bucket tappet, since bucket tappets can absorb the lateral forces arising during operation. The tappet then in turn drives the high-pressure fuel injection pump. An advantageous refinement of the present invention therefore resides in the fact that the holder for the attachment of high-pressure fuel injection pumps additionally has one or more bores for receiving at least one tappet.

In a further refinement of the invention, the abovementioned tappet is actuated by a cam of the camshaft, which cam is already present for driving the gas exchange valves. This has the advantage that, in comparison with a version without the holder according to the invention for the attachment of high-pressure fuel injection pumps, no additional components, no additional space and no additional machining steps are required.

In a further advantageous embodiment, at least one additional driving cam for the operation of a high-pressure fuel injection pump is situated on the camshaft of a reciprocating internal combustion engine. As a result, the profile configuration of the driving cam is independent of the requirements for actuating the gas exchange valves. Also, the use of two or more cams for increasing the driving frequency of the high-pressure fuel injection pump, and therefore for increasing the fuel feed power, is thus possible.

In a further advantageous refinement, the holder is dimensioned in such a manner that the space as far as a cylinder-head cover is bridged. In this version, the high-pressure injection pump can be flange-mounted onto the outside of a reciprocating internal combustion engine. This permits the high-pressure injection pump and the associated fuel and electric connections to be installed in a simple manner.

One advantage of the present invention is the improved attachment of a fuel high-pressure injection pump to a cylinder head of a reciprocating internal combustion engine in such a manner that an enlargement of the cylinder head is not necessary. A further advantage is that no additional machining of the cylinder head is required for the attachment of a fuel high-pressure injection pump. A further advantage is the simple retrofitting of a reciprocating internal combustion engine, which is already in production, with a fuel high-pressure injection pump.

BRIEF DESCRIPTION OF DRAWINGS

The invention will be explained in greater detail with reference to the exemplary embodiment shown in the attached drawing, in which.

DETAILED DESCRIPTION

Figure 1:
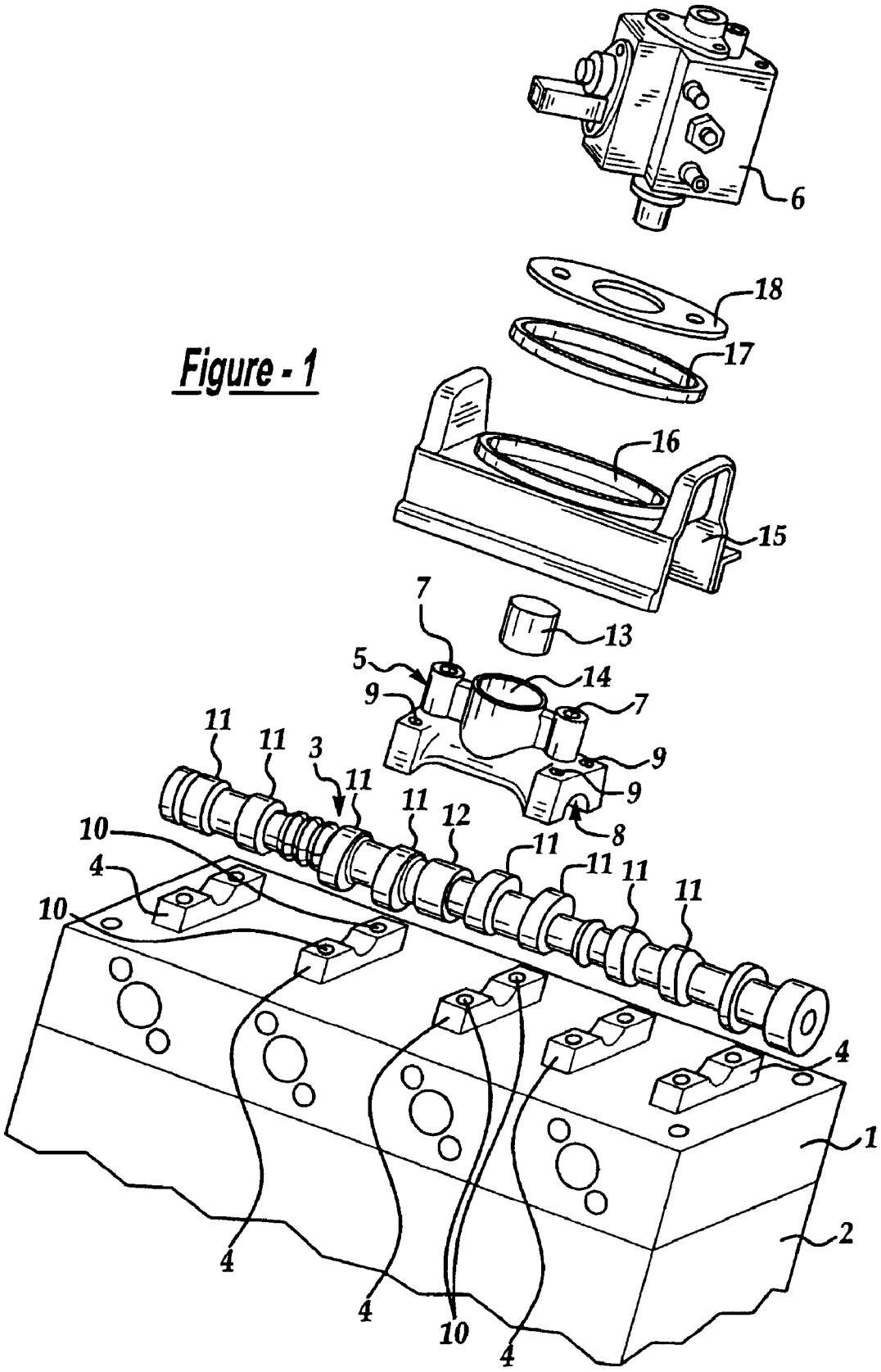
FIG. 1 shows a diagrammatic perspective view of the cylinder head assembly according to the invention for the attachment of high-pressure fuel injection pumps and other adjacent parts.

FIG. 1 shows an exploded view of the cylinder head assembly. A cylinder-head 1 is mounted on a schematically shown cylinder block 2 of a reciprocating internal combustion engine. For supporting a camshaft 3, several camshaft bearing supports 4 are arranged onto the cylinder head 1. A holder 5 for the attachment of a high-pressure fuel injection pump 6 comprises two thread bores 7 for bolting the pump 6 onto the holder 5, and two camshaft bearing caps 8. Two bores 9 are located beside each camshaft bearing cap 8, through which the holder 5 is bolted onto two of the camshaft bearing supports 4, whereby each camshaft bearing support 4 comprises two thread bores 10, which are related to the bores 9 in the holder 5.

The camshaft 3 comprises a number of cams 11 for actuating gas exchange valves, and an additional cam 12 for actuating a bucket tappet 13, which runs in a bore 14 of the holder 5 and transfers the movement of the cam 12 to the high-pressure fuel injection pump 6.

The holder 5 extends toward a cylinder-head cover 15, which is only illustrated partly, in such a manner, that the high-pressure fuel injection pump 6 can be flange-mounted on the outside or the cylinder-head cover 15. To ensure contact between the driving bucket tappet 13 and the high-pressure fuel injection pump 6, the cylinder-head cover 15 comprises an opening 16. When the high-pressure fuel injection pump 6 is bolted onto the holder 5, a gasket 17 and a sealing plate 18 are located between high-pressure fuel injection pump 6 and cylinder-head cover 15 to close the opening 16 and ensure sealing.

While a preferred mode for carrying out the invention has been described in detail, those familiar with the art to which this invention relates will recognize alternative designs and embodiments for practicing the invention. The above-described embodiment is intended to be illustrative of the invention, which may be modified within the scope of the following claims.

What is claimed is:

1. A cylinder head assembly of a reciprocating internal combustion engine, comprising:

a camshaft fitted to said cylinder head with at least two camshaft bearing caps; and a holder for the attachment of a high pressure fuel injection pump onto said cylinder-head, wherein said holder contains at least one of said camshaft bearing caps.

2. A cylinder head assembly according to claim 1, wherein said holder contains at least one bore for receiving at least one tappet.

3. A cylinder head assembly according to claim 2, wherein said tappet is actuated by an existing cam of said camshaft.

4. A cylinder head assembly according to claim 2, wherein said tappet is actuated by an additional cam of said camshaft.

5. A cylinder head assembly according to claim 1, wherein said holder is dimensioned in such a manner that said high-pressure fuel injection pump can be flange-mounted onto the outer surface of a cylinder-head cover.

* * * * *